United States Patent [19]

Schreiber

[11] Patent Number: 5,058,816

[45] Date of Patent: Oct. 22, 1991

[54] COPS PREPARATION STATION

[75] Inventor: Manfred Schreiber, Horgen, Switzerland

[73] Assignee: Maschinenfabrik Rieter AG, Winterthur, Switzerland

[21] Appl. No.: 407,745

[22] Filed: Sep. 15, 1989

[30] Foreign Application Priority Data

Sep. 23, 1988 [CH] Switzerland ..... 03545/88
Nov. 7, 1988 [CH] Switzerland ..... 4126/88

[51] Int. Cl.[5] ..... B65H 54/00

[52] U.S. Cl. ..... 242/18 R; 242/35.5 A; 242/35.6 E; 57/262

[58] Field of Search ..... 242/18 R, 35.5 R, 35.5 A, 242/35.6 E, 36, 37 R; 57/262

[56] References Cited

U.S. PATENT DOCUMENTS

| | | | |
|---|---|---|---|
| 3,591,951 | 7/1971 | Urano et al. . | |
| 3,992,864 | 11/1976 | Igel | 57/262 |
| 4,544,107 | 10/1985 | Matsui et al. | 242/35.5 A |
| 4,576,341 | 3/1986 | Matsui et al. | 242/35.5 A |
| 4,681,271 | 7/1987 | Matsui et al. | 242/18 R |
| 4,723,720 | 2/1988 | Matsui et al. | 242/18 R |
| 4,735,369 | 4/1988 | Suzuki | 242/18 R |
| 4,798,348 | 1/1989 | Matsui et al. | 242/18 R X |
| 4,842,206 | 6/1989 | Kawasaki et al. | 242/18 R |
| 4,858,836 | 8/1989 | Tone et al. | 242/18 R |

FOREIGN PATENT DOCUMENTS

| | | |
|---|---|---|
| 569911 | 8/1958 | Belgium . |
| 128121 | 5/1984 | European Pat. Off. . |
| 2305260 | 8/1974 | Fed. Rep. of Germany . |
| 2351312 | 12/1979 | Fed. Rep. of Germany . |
| 1785236 | 1/1983 | Fed. Rep. of Germany . |
| 3630836 | 3/1987 | Fed. Rep. of Germany . |
| 3742348 | 6/1988 | Fed. Rep. of Germany . |
| 3632459 | 9/1988 | Fed. Rep. of Germany . |
| 3918788 | 12/1989 | Fed. Rep. of Germany . |
| 411648 | 11/1966 | Switzerland . |

*Primary Examiner*—Stanley N. Gilreath
*Attorney, Agent, or Firm*—Burns, Doane, Swecker & Mathis

[57] ABSTRACT

In a cop preparation station having a customary thread detector and an additional thread detector the presence or absence of the upper portion of the thread package and optionally of the lower portion of the thread package of a cop is first detected by light barriers or sensors. A suitable thread finding device is then used in dependence on these values which are found.

The application also describes the cooperation of the cop preparation station with a rewinding machine.

21 Claims, 3 Drawing Sheets

7
6
1
2
3
8
4
9
5

33
13
12
24
23
13.1
17
18
29
32
30.1
26
47
24.1
19
30
31
14
1
14
35
3
20

40
2
3
43
6.1
1
43
45

40
2
3
43
6.1
1
43

6
2
1
3
44
9
44

2
37
1
3
43.1
9
43.1

COPS PREPARATION STATION

BACKGROUND OF THE INVENTION

The present invention relates, in a first aspect, to a method for finding a thread end with a cop preparation station as well as a cop preparation station .

Cop preparation stations in accordance with the first aspect are located between a rewinding machine and a spinning machine and are, as a rule, integrated into the rewinding machine. The spinning machine delivers thread packages with a relatively small diameter which are wound on sleeves and which are called cops. The thread end of a cop which arises is released from the surface of the thread package by a thread finding means, which can consist of a suction nozzle and of a brush, in order to enable a subsequent automatic thread connection in the rewinding machine. The thread end position, i.e. the location at the surface of the thread package where the thread end is normally located can be different and depends on the execution of the spinning machine. Most ring spinning machines have for example no integral doffer and deliver cops with an underwinding although ring spinning machines with integral doffers, which are increasingly being used, deliver the cops with a reserve winding or jacket winding.

Occasionally cops are also encountered with a top winding. In order to operate with compatible machines the manufacture of the rewinding machine includes a thread finding means in the thread preparation station which is matched to the nature of the thread end position. For reasons of economy only about 15 seconds is available for the detection and search process of the thread finding means. When the thread end cannot be found in this time interval the relevant cop is ejected and is automatically returned to the cop preparation station where an operator periodically passes by in order to inspect the faulty cops, to release the thread end by hand and to bring it into the correct thread end position. With an increased occurrence of cripple cops, the use of an operator is no longer sufficient. As referenced herein, "cripple" cops are cops which do not conform to an ideal shape due, for example, to improper formation. These cops thus constitute irregularly shaped cops. It can then transpire that such cripple cops are repeatedly ejected onto the return loop during each search process which can lead to cop queues due to an assembly of cops improperly retained at the spinning machine and to non-utilised winding stations at the rewinding machine. For example, a case of this kind can occur when with a thread break the operator at the spinning machine applies or winds onto the cop an auxiliary thread, without connection, instead of connecting the thread end on the cop located in the spinning location with an auxiliary thread. The upper end of the auxiliary thread is set in both cases in the region of the outlet rolls of the drafting mechanism. Thus cop thread packages arise with several part lengths of fibers, the thread ends of which are initially detected to a large degree in the cop preparation station whereafter the cops enter into the rewinding machine. Here these cops are unwound up to the end of a part length of thread and are then separated out, whereupon the cripple cops which arise in this way reach the return guidance loop again. In the cop preparation station the cripple cops are again subjected to the contact of the brushes whereby the quality of the thread suffers and, since the thread end has still not been found are separated out again. It is to be assumed that this is the reason why the piecing process of the service robot by means of an auxiliary thread—without connection—was therefore not able to establish itself in practice.

It is the object of the invention, in its first aspect, to increase the economy and the degree of efficiency of a cop preparation station and thus of the entire rewinding machine, even in the presence of cops having thread lengths in several parts and cripple cops of all kinds, using the simplest means, and simultaneously to reduce the number of service personnel. The thread should also be more carefully treated.

At this point DE-OS 37 42 348 should be mentioned, which has only been recently published, the object of which is to make it possible "to successfully find a thread end for almost all spools". In order to achieve this object, an airflow control plate is provided close to the outer periphery of the thread package of the cop and an air nozzle is provided in the gap which is formed in this way and blows upwardly parallel to the longitudinal axis of the cop with the object of bringing a thread end which hangs downwardly not in the predetermined position into the region of a thread detection means. In the event that the thread end is located on the upper slope of the thread package of the cop it will be evident, in particular after studying the subsequent description, that the thread end cannot be released by upward blowing.

Furthermore, reference is made to the cop preparation station described in DE-OS 36 32 459 which effects an appropriate adaptation of the thread search operation in order to distinguish between cops with S and Z turns. This adaptation lies in the fact that the direction of cop rotation during the searching process is selected in accordance with this turn.

SUMMARY OF THE INVENTION

Whereas, in accordance with the first aspect of the present invention the thread searching process is placed in the foreground. A second aspect of the invention is more concerned with the integration of the thread search process in the working of the rewinding machine or in the cooperation of the cop preparation station with the rewinding machine.

In accordance with the second aspect, the invention relates to a method of controlling a thread searching station at textile machines, with a thread searching process which takes place in a controlled manner to find the thread end on a cop comprising a thread package and a sleeve. Furthermore the invention relates to an apparatus for carrying out this method.

With the risk of repeating some of that which has already been said it should be emphasized at this point that a thread searching station in accordance with the second aspect will generally operate in conjunction with a winding machine. A further textile machine, in particular a spinning machine can be inserted before this configuration. As a rule the spinning machine will be a ring spinning machine. In the following description the operation of the invention will be described with reference to the cooperation with a prior ring spinning machine. This example is not intended to be restrictive since the invention brings fundamental advantages both for the thread search station per se and also for the association of the thread searching station with a winding machine and further textile machine.

In modern ring spinning machines a plurality of supply bobbins are supported in a so-called creel. A spinning string is spun by a fiber band which proceeds from each of the supply bobbins and in the spinning string a fiber band passes as a roving to the drafting mechanism where it is stretched by drawing it to the final material thickness. Each stretched thread is wound in parallel onto a sleeve which is set into rotation on a spindle. A thread package is wound onto the sleeve under the control of a ring traveller. The sleeve with the thread package is termed a cop. If the cops are full, i.e. wound up to a predetermined dimension then they are drawn off with a doffer and are passed to a winding machine, or to a winding station, for rewinding onto larger spools. During this rewinding process the thread ends of sequential cops or the thread ends after a thread cleaning cut are connected together by machine so that a continuous thread is present on the final spool.

During spinning and also the subsequent winding process thread breaks occasionally occur and it is important to overcome these within the shortest possible time so that the downtimes on the machine can be kept as small as possible. If the number of thread breaks exceeds a certain limit then this is disadvantageous, particularly on spinning machines with a large number of spinning stations. Thus, by way of example, various methods and pieces of apparatus are known for alleviating thread breaks directly at ring spinning machines and are essentially directed to finding the thread end on the cops effected by the thread break, which is initially present on the ring spinning machine, to re-threading the thread end and to subsequently connect it again with the roving. These attempts frequently fail whereby the degree of efficiency of the machine is negatively influenced.

With the intention of better controlling the indicated difficulties a service carriage was proposed in accordance with DE-OS 17 85 236 for the twisting together of torn threads, in which the thread end on the spool is not sought but rather an auxiliary thread is wound onto the spool which can be engaged in the piecing apparatus and the other end of which is connected with the roving. However, in accordance with DE 23 51 312 or U.S. Pat. No. 3,992,864 for example, this proposal is disadvantageous to the extent that no connection exists between the broken thread and the newly started thread so that on withdrawing the thread from the cop at the automatic cheese winder a thread break is present which is regarded as disadvantageous. The above proposal was not then pursued in practice.

The cops must be supplied with a prepared thread end to the automatic cheese winder on which the cops are rewound to larger thread packages. For this purpose all cops which come from the spinning machine as well as the cops where a thread break has occurred and cops which are returned again from the winding station pass through a cops preparation station. The cops preparation station contains devices for searching for the thread ends on the cops which can operate in accordance with a mechanical and/or pneumatic and/or electrical principle, and indeed in accordance with a functionally and timewise strictly predetermined scheme of operation. The course of this operation of such known cop preparation stations was previously relatively rigid and could only be matched to a limited degree to the build-up of the thread package or to the position of a thread break on the cops. The search process for the thread end was always the same, irrespective of whether a cop of fault-free shape or a faulty cop was supplied. By way of example a search was each time made for underwinding and reserve windings on the cop even when these were not present at all on the faulty cops. This signifies that earlier cop preparation stations lost much time for the search process for the thread ends and, moreover, that frequent interruptions of production and time losses arose in the cheese winder.

A cop preparation station was admittedly proposed in DE 36 32 459 which is laid out to distinguish between cops with S- and Z-rotation and with corresponding adaptation of thread searching operations. The adaptation lay in selecting the direction of rotation of the cops during the search process in accordance with the twist.

In order to alleviate the above identified disadvantages it has furthermore been proposed by the applicants to provide an additional thread detection means in addition to the prior thread detection means and to provide a cop checking apparatus with one of the thread detection means being activated by a corresponding signal of the cop checking apparatus. It is the object of the present invention in the second aspect to further develop a method and an apparatus of the initially named kind in such a way that the course of operation at the cop preparation station can be shortened and further automated, and thus such that time can be saved, so that one can operate with coupled production, for example with a spinning machine and a subsequent automatic cheese winder, with an even greater degree of efficiency, as far as possible while using unitary or at least compatible control means.

The decisive advantage of this method lies in the fact that after detecting the shape and the position of the thread package on the spinning sleeve in the cop preparation station an individual part program is initiated from a total thread search program and is matched to the respective cop and to the data associated therewith. Through the typewise localization of the thread end only those portions of a complete thread search program enter into operation in the cop preparation station which correspond to the actual possible position of the thread end on the thread package.

With the condition that this measure is taken, a thread break at the spinning machine can now also be ideally dealt with and with high reliability by directly winding on a new thread without repairing the thread break. The tedious and often unsuccessful seeking of the thread end directly on the spinning machine is avoided. Thus production time for the spinning machine is won and the throughput of cops on a coupled spinning machine and winding machine is increased. The data which is determined can be evaluated in the context of a process control or operational data detection for further control and monitoring purposes.

BRIEF DESCRIPTION OF THE DRAWINGS

The invention will now be explained in more detail in the following with reference to the drawing in which are shown schematically.

DETAILED DESCRIPTION OF PREFERRED EMBODIMENTS

Figure 1:
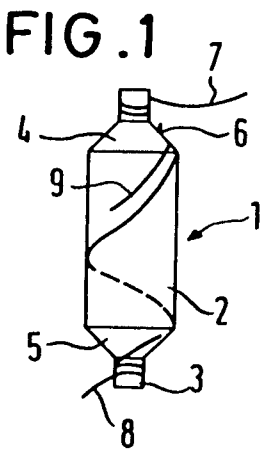
FIG. 1 shows a cop with an ideal front profile.

FIG. 1 shows a cop 1 with a body of thread or a thread package 2. The thread package wound on a sleeve 3 has an upper portion 4 having a conical surface or an inclined surface 6, which is in reality somewhat more pointed than as shown in the illustration, and a lower portion 5, also termed the cop base, which is in reality somewhat rounded. In this figure three possible different types of winding are shown; a top winding 7, an underwinding 8 and a reserve winding or jacket winding 9. The designations "top" and "under" relate to the normal position of the cops in the spinning station of the spinning machine and will be retained in the following even in the case when the cop lies horizontal in the cops preparation station.

Figure 2:
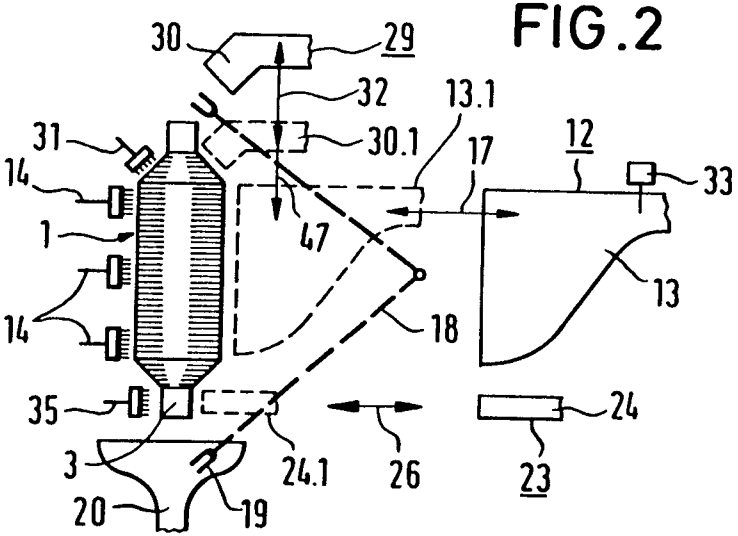
FIG. 2 shows a cop in a partial side view schematic of a preparation station in accordance with the invention.

FIG. 2 shows a thread detection means 12 which is matched to a reserve winding 9 and which comprises a suction nozzle 13 and a number of brushes 14 which are hingedly mounted, are movable perpendicular to the surface of the thread package and are located, in the normal case, on the same side of the suction nozzle. The suction nozzle 13 (continuous lines) with the brushes 14 are located in the position ready for use and move in accordance with the double arrow 17 into the working position 13.1 shown in broken lines after the cop 1 has been placed in the cop preparation station. In the cop preparation station the cop 1 is automatically turned in a direction to unwind the thread of the cop the brushes 14 adapt to the profile of the thread package 2 and release the thread end, with the suction nozzle 13.1 simultaneously sucking away this thread end and subsequently moving into the position ready for use again.

A grasper arm 18 (the two broken line positions show its working range) having a gripper 19 picks up the thread end or the end region of the thread end from the suction nozzle 13 and transfers the thread end to a central suction system 20. Thus the thread end has been found and has been engaged for the subsequent rewinding process on the winding machine.

The cop preparation station can be equipped with a thread detection means 23 in place of the thread detection means 12. This would be the case if an underwinding is to be released since the thread end position is then located on the sleeve 3 beneath the base of the cop 5. In analogy to the thread detection means 12 the thread detection means 23 comprises a suction nozzle 24 and at least one brush 35 and is movable in accordance with a double arrow 26 between a position ready for use shown in full lines and a working position (reference numeral 24.1) shown in broken lines.

In this case the gripper 19 also picks up the thread end from the suction nozzle 24 and transfers it to the central suction system 20. A thread detection means which is matched to the less frequent top winding 7 and thus to a thread end position on the sleeve 3 above the upper portion for the yarn package is not shown. A thread detection means of this kind would be identical with the thread detection means 23. Naturally it is also conceivable to equip the cop preparation station with both the thread detection means 12 and also the thread detection means 23, with the thread detection means 12 and 23 coming into operation simultaneously or after one another. In this respect it is clear that one of these thread detection means carries out a superfluous operation and unnecessarily scrapes a portion of the yarn package which is disadvantageous for the thread quality. In accordance with the invention an additional thread detection means 29 is provided which is in particular aligned with or matched to a thread end position present on the upper part 4 of the yarn package. The thread engagement means 29 again consists of a suction nozzle 30 and a thread end releasing means, a brush 31, and can be moved in accordance with the double arrow 32, for example vertically, from a position ready for use shown in full lines into a working position 30.1 shown in broken lines. The FIGS. 3 to 6 will be explained on the assumption that the spinning machine positioned before the cop preparation station delivers cops with a reserve winding 9. The cop preparation station is thus normally only equipped with the thread engagement means 12, since the thread end is then only to be sought in the cylindrical region of the thread package 2.

The search process will now as previously first be terminated after approximately 15 seconds even when the thread end has already been found after one second in a searching process for which a certain time is available, for example 15 seconds, i.e. during 14 seconds the thread will be sucked off away or sucked into the suction system. In order to avoid this non-useful thread loss and to simultanously save the 14 seconds, a thread detector 33 is provided in each thread engagement means (only shown for the thread detection means 12) which prematurely terminates the thread searching process when a thread is present. The suitable thread engagement means which is in use is thus prematurely deactivated.

Figure 5:
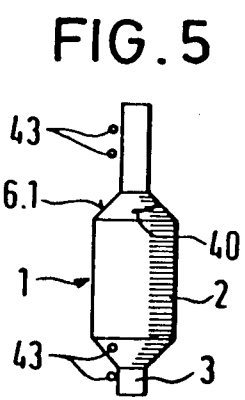
FIG. 5 shows a front view profile of a third cripple cop.
Figure 4:
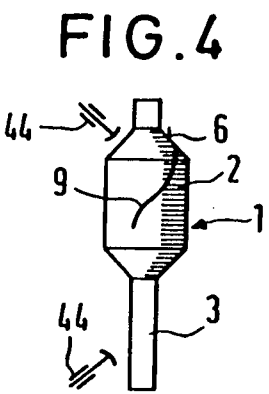
FIG. 4 shows a front view profile of a second cripple cop.
Figure 3:
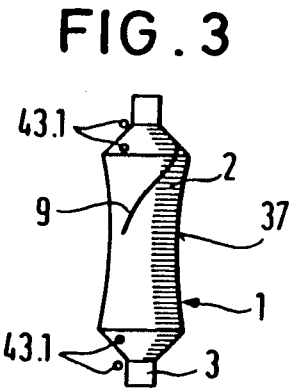
FIG. 3 shows a front view profile of a first cripple cop.

FIG. 3 shows a cripple cop, the yarn package 2 of which has a waist 37 in the cylindrical region. The cause is most probably a thread break which has occurred during the winding process but which has been remedied. A reserve winding 9 should therefore be present. FIG. 4 shows a cripple cop in which only the upper part of the yarn package 2 is intact. The cause would be a delay in the laying of the thread onto the sleeve 3 compared with other cops on the spinning machine. Since the winding process normally starts in known manner on the sleeve with the cop base 5 it is clear that the winding process must normally be carried out until it has finished. Thus a reserve winding 9 should be present. FIG. 5 shows a cripple of a different kind. The lower part of the thread package and thus the lower portion 5 is present. The upper part of the thread package 2 is missing or is incomplete. The cause here points to a thread break during spinning. The thread end position or the thread end 40 is located on the upper inclined portion 6.1 beneath the top most inclined portion 6 of a cop with an ideal profile. The cripple cop of FIG. 6 has both an incomplete upper portion and also an incomplete lower portion. The cause is delayed application of the thread as in FIG. 4 with an additional thread break. The thread end 40 is located on the top inclined portion 6.1.

In the cop preparation station a cop checking apparatus is likewise provided which can have two pairs of light barriers. Each pair of light barriers is generally labelled 43 as shown in FIG. 5. As shown in FIG. 3, one light barrier labelled 43.1 of each pair 43 can serve as a reference light barrier having an output which is compared with an output from the other light barrier of that pair. Moreover, sensors, for example resilient sensors 44 can also be provided in place of the light barriers. The manner of operation is the following.

After placing a cop in the cop preparation station the upper portion of the yarn package 4 and the lower portion 5 of the yarn package 2 are checked and scanned, always related to a cop with an ideal profile. With a cop in accordance with FIG. 3 the pairs of light barriers 43 determine the presence of both the upper portion 4 of the thread package and also the lower portion of the thread package and merely give a signal to the thread detection means 12 whereupon the suction nozzle 13 with the brushes 14 is brought from the position ready for use into the working position 13.1. The thread engagement means 29 remains in the position ready for use. On the arrival of a cop in accordance with FIG. 4 the sensors 44 only determine the presence of the upper portion 4 of the thread package. Thereupon the thread engagement means 12 is set into operation precisely as with a cop in accordance with FIG. 3. Should a cop in accordance with FIG. 5 enter into the cop preparation station then the pairs of light barriers 43 or the sensors 44 will determine the presence of the lower portion 5 of the thread package and the absence of the upper portion 4 of the thread package. In this case only the thread engagement means 29 is activated with an energization signal while the thread engagement means 12 remains in its position ready for use. The suction nozzle 30 is guided vertically downwards in accordance with the double arrow 32, and proceeds further downward in accordance with the arrow 47 until the brush 31 contacts the inclined portion 6.1 whereupon the suction nozzle 30 is stopped. The thread engagement means 29 is also movable over the entire filling height of the thread package of the cop. Even when the upper portion 4 of the thread package and the lower portion 5 of the thread package are missing, such as is the case with a cop in accordance with FIG. 6, the checking means or the cop checking apparatus 43, 44 is so laid out that only the thread engagement means 29 comes into use. The pairs of light barriers 43 or sensors 44 which are aligned with the lower portion of the thread package can optionally be omitted.

The cop checking apparatus 43, 44 thus excites or activates either the suction nozzle 13 which is normally provided in this case, or the additionally provided suction nozzle 30, depending on where the probability of finding a thread end is highest In this way searching for the thread end which would be unsuccessful from the outset is not even started. This leads to an increased degree of efficiency and thus to increased economy of the entire winding machine. Degrees of efficiency of 99% can be straightforwardly attained particularly when the cops are conveyed on plate trays, also termed peg trays, whereby the thread ends of a thread package 2 do not come into contact with the thread ends of other thread packages 2, and wherein the thread end is accordingly not pressed into the surface of the thread package 2 by banging against another cop. The thread end of cripple cops of all kinds can practically always be found straightaway and within the available time of approximately 15 seconds even of cops in accordance with FIGS. 5, 6 which have partial thread lengths. Service personnel for inspecting the ejected cops is no longer necessary since if a cop in accordance with FIGS. 1, 3 is processed in the cop preparation station then the winding station of the winding machine will eject the relevant cop onto the return guidance loop on the occurrence of a thread break, i.e. of a thread end 40. It is however certain that the thread end of this ejected cop, which now has the form of FIG. 5, will be found when it re-enters into the cop preparation station. Only that portion of the thread package is scraped or contacted where the thread end is most probably located, which enhances the thread quality.

The cop checking apparatus could also have a weighing device 45 with which the cop is weighed. If the weight that is found lies within a predetermined tolerance then it can be concluded that one is concerned with a cop in accordance with FIG. 1, whereby the thread engagement means 12 is automatically activated.

Figure 7:
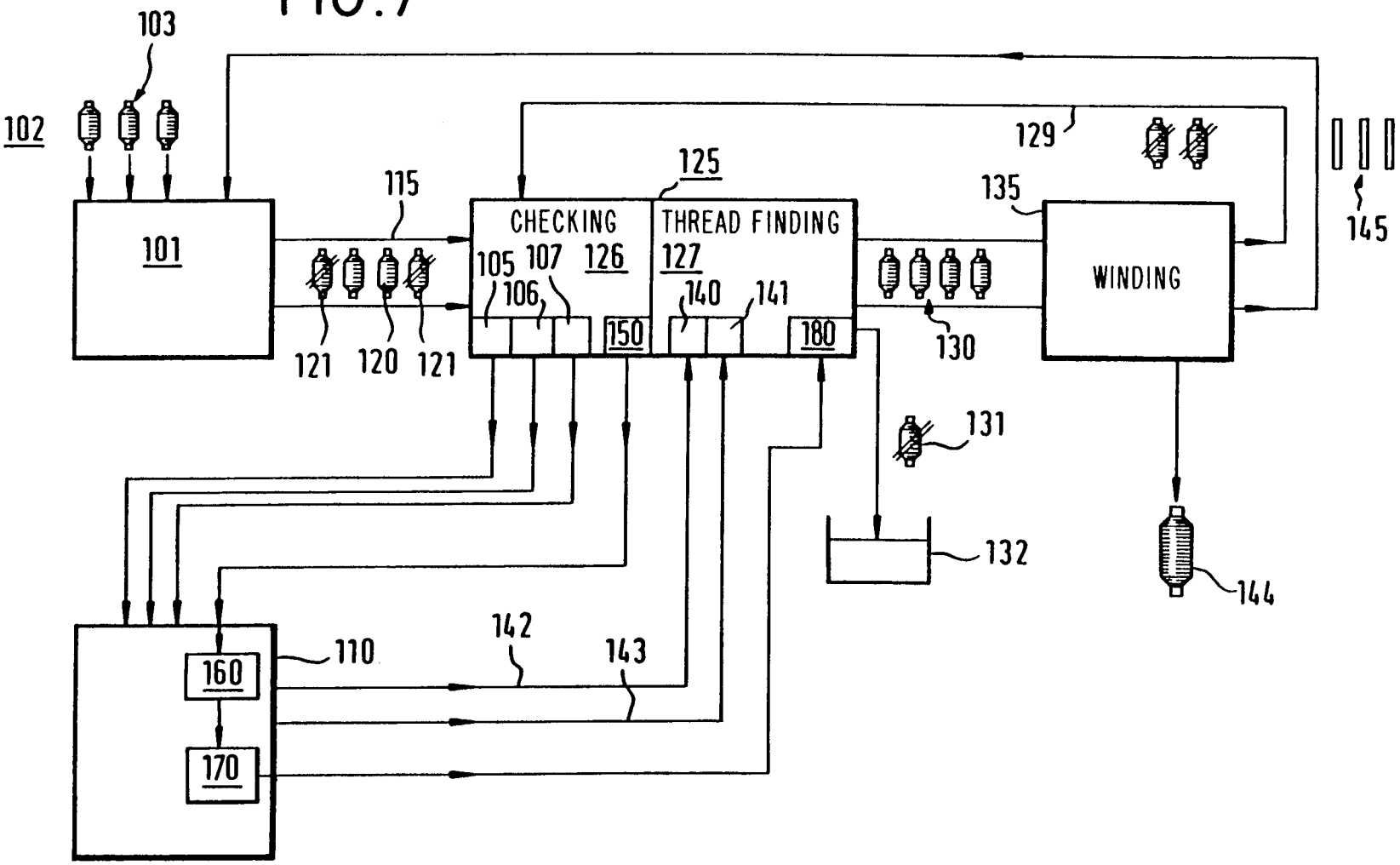
FIG. 7 shows the various machine and control elements in a block representation.

FIG. 7 shows a ring spinning machine 101 shows as a block with a creel 102 for receiving roving bobbins 103. The ring spinning machine 101 includes conventional elements such as a drafting mechanism, thread guiding elements, ring travellers and spindles for receiving the sleeves on which the thread packages are formed, and also eventually an auxiliary thread piecer. An extensive description of these elements which are named per se will not be given in favor of a clear illustration of the elements of the present invention.

Cops 120 which are not affected by thread breaks and cops 121 with non-continuous threads are drawn off jointly from the spindles of the spinning machine 101 during the doffing process and are passed via transport means 115 to a cops preparation station 125. From there prepared cops 130 with identified thread ends are transferred to a winding station 135.

The cop preparation station 125 contains as essential components a checking device 126 and a thread searching device 127. Data detection elements 105, 106, 107, for example sensors or other measurement transducers which are arranged at a suitable position on the path of the cops from the spinning machine 101 to the cop preparation station 125 cooperate with the checking device 126. The checking station 126 and in particular the data detection elements 105 to 107 are connected to a computer 110 in which for example a process control is integrated. The data which arises can be transferred to further data processing means or storage elements or to data carriers in stored form.

The checks which are carried out in the station 126 can for example, and advantageously, be those checks which are described in connection with FIGS. 3 to 6.

The object of the thread searching device 127 within the cop preparation station 125 is the searching for and the laying bare of the thread end, and the preparation for the further processing of the prepared cop 130 at the winding station 135. Cops 131 of which the thread end could not be laid free with the thread searching device 127 after passing several times through the later described processing steps are returned from the cop preparation station 125 into a cop store 132 for manual processing. For this purpose an ejection device 180 is provided which is controlled via a signal transmitter 170 from computer 110.

Not all the prepared cops 130 which are passed on to the winding station have a continuous thread. If a cop with a broken thread reaches the winding station then it is rewound until the point of breakage. The thread break then causes an interruption at the corresponding winding station. The cop is ejected and is transported via a cop return guide 129 back to the cop preparation station 125. There the cop however once again runs through the checking station 126 and the thread searching device 127. With a prepared thread end the cop is then once again supplied as a prepared cop 130 to the winding station 135 for further rewinding.

If the sleeves of the cops are marked then the number of such return passages of the same cop from the winding machine 135 to the cop preparation station 125 can be restricted via the process control. For example marking laser 150 detects the identity of the cops and delivers this data to a counting and comparison device 160 in the computer 110. If it is found through a comparison with preset values that the permissible number of returned passages of the same cop has been exceeded, then it can be assumed that the cop contains many individual threads, and the signal transducer 170 and thus the ejection device 180 in the cop preparation station 125 are activated. The faulty cop 131 is then ejected into the cop store 132 so that idle running in the production process is avoided. Not only cops for which a thread break has been determined, and for which the winding station is no longer able to connect the two thread ends of the cop and coil, are returned from the automatic cheese winder 135 to the cop preparation station 125. The same consequence also arises for stress breaks on the automatic cheese winding unit 135 which occur during the rewinding process and which interrupt the winding process. In contrast a thread cleaning cut with a correct unwinding of the cop is not regarded by the process control as an interruption of the winding process which should have the consequence of a return of the relevant cop. The finished coils 140 arise at the output of the winding station 135 while the emptied sleeves 145 are returned to the spinning machine 101.

The advantageous cooperation between the checking station 126 and the thread searching device 127 will now be described in the following in conjunction with a selective control of thread searching processes. All cops reach the checking station 126 with a defined orientation, for example with the tip directed upwardly. In the first checking step it is determined whether the cop or its thread package is fault-free in its position on the spinning sleeve and from the point of view of its shape (contour). A cop or its thread package is fault-free when the start of the thread package and the end of the thread package on the spinning sleeve are located at the starting and end positions which are preset by the ring spinning machine and when the thread package has a cylindrical shape with underwindings and/or reserve windings or overwindings (tip bunch). Here deviations lying within specific limits may be permitted. If these conditions are satisfied then no spinning thread break is present.

Cops which are identified in this manner as fault-free are treated further in the thread searching station 127 by means of various elements known per se to lay free the thread end. For example the cops are investigated in accordance with the previously derived test data with respect to underwindings and/or reserve windings and top windings and the thread end is freed. The cops 30 which are treated in this manner are transferred with the prepared thread end to the winding station of the automatic cheese winding unit 135.

If however, a shape or contour error of the cop is determined by the checking device 126 then it is checked further whether the start and end of the thread package lies at the preset position. If this is not the case, and if the thread package is not cylindrical, but for example has a waist portion, then the underwinding and/or the reserve winding or top winding is released, i.e. the thread end is laid free in the thread searching station by means of various elements. A cop of this kind can subsequently be transferred with a prepared thread end to the winding station of the automatic chease winding unit 135. If an error was found in the checking station 126 in the shape of the cop, and if the start of the thread package is in the preset position, but not however its end, then in the thread searching station the thread end is only sought and laid free in the region at the tip of the cop (on the cone, so-called spinning thread break). The previously customary searching for the thread end at the underwinding and/or at the reserve winding or at the top winding is then no longer necessary and is avoided. The thread end that is found is prepared and the cop can then likewise be transferred to the winding station of the automatic cheese winding unit 135.

A further case in which a fault is found in the shape of the cops can occur when the end of the thread package is at the preset position, however its start is not at the preset position. In this case the thread searching station effects a release of the underwinding and/or of the reserved winding or of the top winding and may bear the thread end.

If both the start and also the end of the thread package are not in the preset position then thread searching processes are only initiated in the region of the tip of the cop.

The selective control of the thread searching elements 140, 141 preferably takes place in a servo-controlled manner by means of control inputs 142, 143 from the computer 110 in accordance with a preset control algorithm in dependence on the data of the data detection elements 105–107 of the checking station 126. During this further process parameters are also taken into account which are related to the respective material quality or thread quality.

The program-controlled thread searching device 127 is for example provided with a thread detector which triggers an immediate interruption of the further searching process as soon as a thread is found. If the thread is found then a cop transfer apparatus 130 is activated which initiates the transfer of the prepared cop 130 to the winding station 135. The process control is preferably so laid out that on reaching a preset number of cases in which a thread end is not found in a direct sequence the faulty cop 131 is ejected by the ejection means 180 out of the cop preparation station 125 into the cop store 132.

Figure 8:
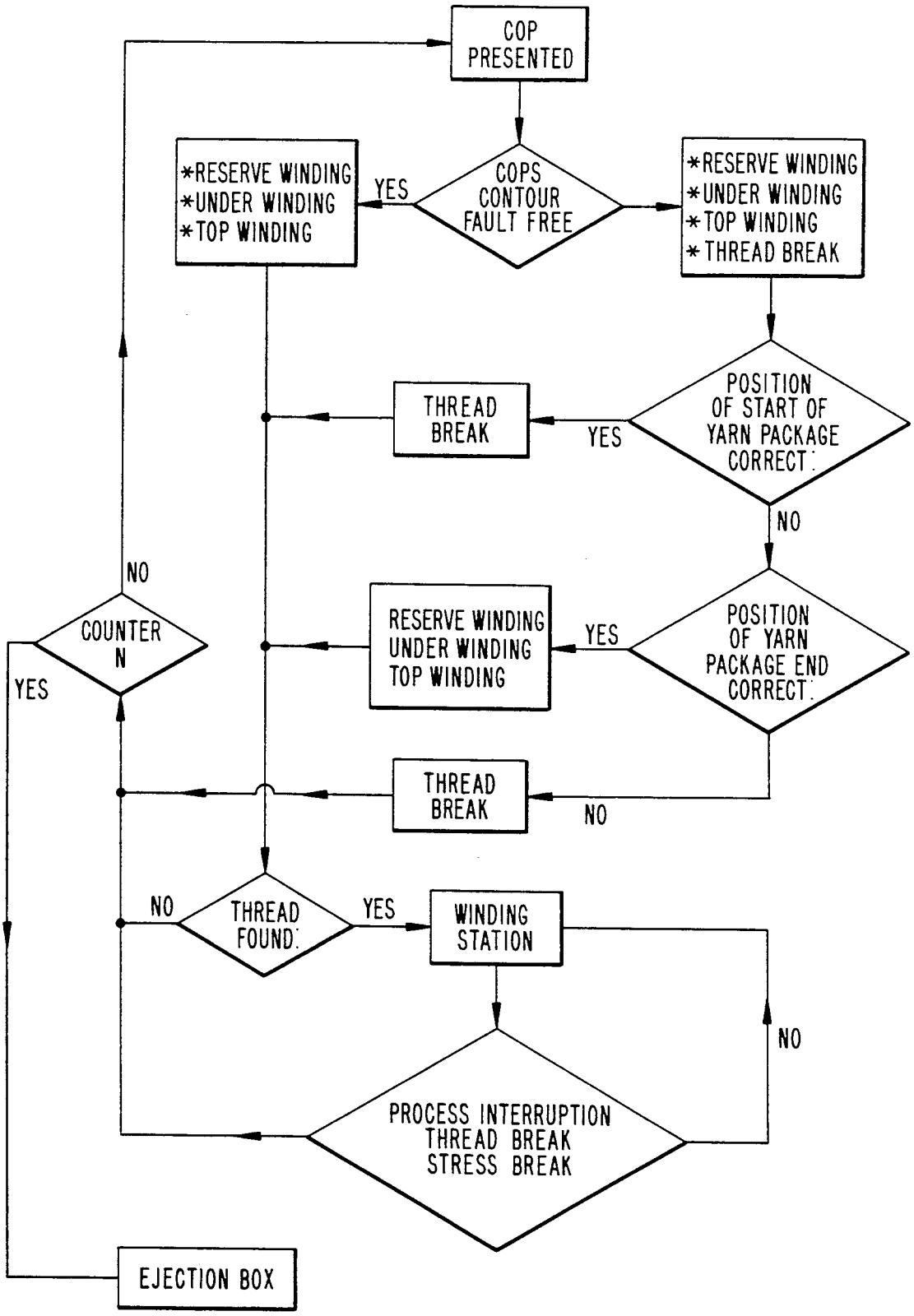
FIG. 8 shows the functional sequence in accordance with a preferred embodiment for cops preparation.

An example of the course of the above described process is illustrated in FIG. 8. The yes/no decision stages relate to measurement data which has been found, with the decisions preferably being taken by the computer 110 as a result of the operating program which is fed into it. Relevant data which relate to the cops or to the thread material or other later required data of the spinning and winding process are stored. They can be used for the further process control. Furthermore conclusions can be drawn from this data relating to the operating state of the individual spinning stations on the spinning machine. Thus, by way of example, the test data concerning the position and shape of the thread package which arises at the cop preparation station can be evaluated, or data from the spinning machine related to the spinning stations, in particular when the sleeves are provided with an identification mark and, for example the number of thread breaks at the respective spinning station is also determined in addition to the previously mentioned data. This permits a qualitative judgement of each individual spinning station and thus an early fault diagnosis within the overall assembly.

Figure 6:
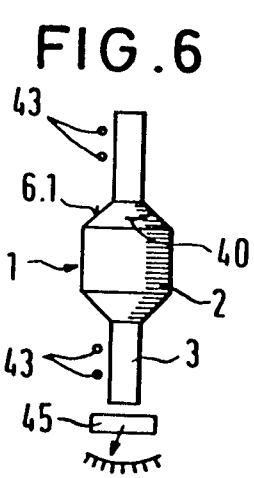
FIG. 6 shows a front view profile of a fourth cripple cop.

As measurement transducers for detecting the shape of the thread package in the checking station of the cop preparation station, weight sensors can for example be provided, such as are indicated with 45 in FIG. 6, which determine deviations in the weight of the finished cop from a predetermined desired weight. Furthermore, position sensors, for example in the form of light barriers 43, 43.1 as shown in FIGS. 3 and 4 are also suitable for determining the contour, and also the position, of the thread package on the sleeve. Sensors for determining the position of the thread package on a cop which is fault-free with respect to its contour can also be arranged at the end of the doffer band of the ring spinning machine.

As a result of the described systematic and typewise detection of thread breakage data the searching and laying free of the thread end takes place in each case specifically in correspondence with the respective thread package. Full cops coming from the spinning machine 1 and thus cops which have been classified as "fault-free" by the checking station 126 are supplied to the winding station 135 with the thread end prepared. Attention is not initially paid to any thread break which may eventually be present on the cop. This thread break first makes itself noticable at the winding station. There a cop with a thread break is ejected and is returned via the cop return 129 to the cop preparation station 125. The cop runs once again through the checking program whereupon, under program control, only those thread searching elements in the thread searching device 127 are activated which correspond to the result of the check. Subsequently the cop with the prepared thread end is supplied again to the spinning station 101 for further rewinding.

The measure by which, under program control, only those thread searching elements of the thread searching device 127 which correspond to the position of the thread end on the thread package enter into operation in the cop preparation station 125 has a particularly advantageous effect on the overall course of the process. In this way the passage of the cops in the cop preparation station is considerably accelerated.

Whereas thread breaks at the spinning machine were previously directly alleviated at the spinning station and with this arrangement notable production losses arose, in particular on large ring spinning machines with 400 to 1000 spin stations, through a reduction of the quantity of thread produced per unit time, it can now be ensured, through the cooperation with the improved cop preparation station, that the cops are made ready as quickly as possible on the spinning machine, so that even with a thread break a complete cop arises while tolerating a non-continuous thread on the cop. Idle periods at the spinning stations for the searching of the thread ends are avoided.

I claim:

1. A method of locating a thread end of a cop during cop preparation comprising the steps of:

identifying a shape of the cop using at least one shape detector;

activating at least one thread detector included in a cop preparation station, the at least one thread detector being selected in response to the shape of the cop.

2. Method according to claim 1, wherein the shape of a cop is identified by first weighing the cop.

3. Method according to claim 2, wherein the shape of said cop is further identified by detecting a location of a thread package along a sleeve of said cop.

4. Method according to claim 1, further comprising the step of:

deactivating said at least one thread detector one the thread is located.

5. A cop preparation station for locating a thread end of a thread package located on a cop comprising:

means for locating a thread end of a cop, said locating means including at least two thread finding detectors;

means for identifying a shape of said cop; and, means for activating selected ones of said thread finding detectors in response to a signal output from said means for identifying.

6. Cop preparation station according to claim 5, wherein one of said at least two thread finding detectors is matched to an upper slope profile of the thread package.

7. Cop preparation station according to claim 6, wherein said means for locating moves said one of said at least two thread finding detectors along a thread filling stroke of the thread package.

8. Cop preparation station according to claim 6, wherein said means for identifying includes at least one light detector for detecting an upper part of the thread package.

9. Cop preparation station according to claim 8, wherein said means for identifying further includes a means for weighing a cop having a thread package.

10. Cop preparation station according to claim 6, wherein said means for identifying further includes a means for weighing a cop having a thread package.

11. Cop preparation station according to claim 6, wherein each of said at least two thread finding detectors further includes means for terminating a thread search process.

12. Method of controlling a textile machine comprising the steps of:

searching for a thread end of a cop, said step of searching further including the steps of:

passing a cop through a checking station;

detecting thread breakage data for said cop in said checking station using at least one sensor; and, controlling a thread searching station in response to said thread breakage data by selectively initiating a search for said thread end at a cop location identified by said thread breakage data.

13. Method according to claim 12, wherein said step of detecting includes the steps of:

determining whether shape faults exist in said cop; and checking upon the detection of a shape fault, whether a start position and an end position of a thread package placed on said cop are located at predetermined positions along a sleeve of said cop.

14. Method according to claim 13, wherein upon detecting said end position is not at a predetermined position, said search for a thread end is selectively initiated at a predetermined tip of said cop.

15. Method according to claim 13, wherein upon detecting said start and said end positions are not at predetermined positions, respectively, said search for a thread end is selectively initiated at a predetermined tip of said cop.

16. Method according to claim 13, wherein upon detecting said start position is not at a predetermined position, said search for a thread end is selectively initiated by searching for underwindings and/or reserve windings or top windings in a predetermined order.

17. Method according to claim 12, wherein said textile machine includes a spinning station, said method further including the steps of:

winding a thread onto a thread package of said cop at said spinning station;

winding a new thread onto a thread package of said cop upon occurrence of a thread break in said thread package at said spinning station; and performing said step of searching upon completion of said winding.

18. Method according to claim 12, wherein said textile machine includes a winding station, said method further including the steps of:

detecting an occurrence of a thread break during unwinding of a thread from said cop in said winding station; and performing said step of searching in response to said thread break detection.

19. A textile machine comprising:

a cop preparation station including a cop checking device and a thread end searching device, said checking device further including:

sensors fore determining a shape and position of a thread package on a sleeve of a cop, and said thread end searching device further including:

selectively controllable thread end detectors; and, means for processing output signals produced by said sensors, said signal processing means producing input signals for controlling said thread end detectors in response to said output signals.

20. Textile machine according to claim 19, wherein said cop preparation station further includes:

means for identifying marked cop sleeves; and, said signal processing means includes means for determining whether said cop has undergone more than a predetermined number of thread searches in said thread end searching device.

21. Textile machine according to claim 19, wherein said cop preparation station further includes means for rejecting said cop upon a determination that said predetermine number has been exceeded.

* * * * *